US011857130B2

(12) United States Patent
Chen et al.

(10) Patent No.: US 11,857,130 B2
(45) Date of Patent: Jan. 2, 2024

(54) CLEANING ASSEMBLY AND CLEANING APPARATUS

(71) Applicants: Yunjing Intelligence Innovation (Shenzhen) Co., Ltd., Guangdong (CN); Yunjing Intelligence (Shenzhen) Co., Ltd., Guangdong (CN)

(72) Inventors: Yun Chen, Shenzhen (CN); Zhaoqun Zhu, Shenzhen (CN)

(73) Assignees: Yunjing Intelligence Innovation (Shenzhen) Co., Ltd., Shenzhen (CN); Yunjing Intelligence (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/587,248

(22) Filed: Jan. 28, 2022

(65) Prior Publication Data

US 2022/0248931 A1 Aug. 11, 2022

(30) Foreign Application Priority Data

Feb. 8, 2021 (CN) ..... 202120366594.3

(51) Int. Cl.
*A47L 11/40* (2006.01)
*A47L 11/24* (2006.01)

(52) U.S. Cl.
CPC ..... *A47L 11/4069* (2013.01); *A47L 11/24* (2013.01); *A47L 11/4058* (2013.01); *A47L 2201/00* (2013.01)

(58) Field of Classification Search
CPC ..... A47L 11/4069; A47L 11/4058; A47L 11/4055; A47L 11/4052; A47L 11/24;
(Continued)

(56) References Cited

U.S. PATENT DOCUMENTS 1,453,049 A * 4/1923 Liddell ..... E01H 1/053 74/400
5,127,124 A * 7/1992 Palmer ..... A47L 11/4058 15/49.1

(Continued)

FOREIGN PATENT DOCUMENTS

CN 205978328 U 2/2017
CN 108013837 A * 5/2018 ..... A47L 11/38

(Continued)

OTHER PUBLICATIONS

Translation of NL-8800638-A (Year: 1989).*

(Continued)

*Primary Examiner* — Brian D Keller
*Assistant Examiner* — Steven Huang
(74) *Attorney, Agent, or Firm* — Leydig, Voit & Mayer, Ltd.

(57) ABSTRACT

A cleaning assembly and a cleaning apparatus are provided. The cleaning assembly includes a fixing mechanism, a lifting shaft, a moving member, a first drive mechanism and a cleaning module. The lifting shaft penetrates through the fixing mechanism and is configured to slide along an axial direction of the lifting shaft relative to the fixing mechanism. One end of the lifting shaft is connected to the cleaning module, and the other end is connected to the moving member. The moving member is configured to cause the lifting shaft to slide along the axial direction of the lifting shaft. The first drive mechanism is connected to the moving member by a transmission device and is configured to cause the moving member to move in a reciprocating motion.

16 Claims, 2 Drawing Sheets

(58) Field of Classification Search
CPC ..... A47L 11/28; A47L 11/282; A47L 11/40; A47L 11/4063; E01H 1/05; E01H 1/053
See application file for complete search history.

(56) References Cited

U.S. PATENT DOCUMENTS

| | | | | |
|---|---|---|---|---|
| 5,815,880 | A | 10/1998 | Nakanishi | |
| 10,064,531 | B2 * | 9/2018 | Ruiz-Porath | A47L 11/305 |
| 2005/0167950 | A1 * | 8/2005 | Martin | A63C 9/0802 280/618 |
| 2013/0095246 | A1 * | 4/2013 | Pollack | A47L 11/4055 427/322 |
| 2019/0142237 | A1 * | 5/2019 | Isenberg | A47L 11/4055 15/98 |
| 2019/0290089 | A1 * | 9/2019 | Johnson | A47L 11/4013 |

FOREIGN PATENT DOCUMENTS

| | | | | | |
|---|---|---|---|---|---|
| CN | 209808233 | U | | 12/2019 | |
| CN | 110710932 | A | * | 1/2020 | A46B 13/001 |
| EP | 0969757 | A2 | | 1/2000 | |
| EP | 3711649 | A1 | | 9/2020 | |
| JP | H0493054 | U | * | 12/1990 | |
| NL | 8800638 | A | * | 10/1989 | E01H 1/053 |
| WO | WO-02062194 | A1 | * | 8/2002 | A47L 11/03 |
| WO | WO-2012147230 | A1 | * | 11/2012 | A47L 11/4005 |

OTHER PUBLICATIONS

Translation of CN-108013837-A (Year: 2018).*
Translation of Jp H0493054 U (Year: 1990).*
Translation of CN 110710932 A (Year: 2020).*

* cited by examiner

CLEANING ASSEMBLY AND CLEANING APPARATUS

CROSS-REFERENCE TO RELATED APPLICATIONS

This application claims priority to Chinese Application No. 202120366594.3, filed on Feb. 8, 2021, which is hereby incorporated by reference in its entirety.

TECHNICAL FIELD

The present disclosure relates to the field of a cleaning apparatus, more particularly to a cleaning assembly and a cleaning apparatus.

BACKGROUND

Usually, a cleaning apparatus such as a cleaning robot or vacuum cleaner moves on the ground, which realizes functions such as automatic sweeping or vacuuming by their cleaning modules. However, a cleaning module of the existing cleaning apparatus has a fixed structure and cannot be lifted up and down. Thus, the contaminated cleaning module will secondarily pollute the ground. In addition, after cleaning, cleaning apparatus such as the sweeping robots or the vacuum cleaner need to enter a base station. At this time, the cleaning module of the cleaning apparatus will contact a slope of the base station, which is easy to cause problems such as accumulation of pollutants on the slope or damage to the cleaning module.

SUMMARY

One objective of the present disclosure is to provide a cleaning assembly and a cleaning apparatus to solve the technical problem that the cleaning module cannot be lifted.

To achieve the above objective, a cleaning assembly is provided, which includes a fixing mechanism, a lifting shaft, a moving member, a first drive mechanism and a cleaning module. The lifting shaft penetrates through the fixing mechanism and is configured to slide along an axial direction of the lifting shaft relative to the fixing mechanism. The lifting shaft includes a first end and a second end. The first end of the lifting shaft is connected to the cleaning module, and the second end is connected to the moving member. The moving member is configured to cause the lifting shaft to slide along the axial direction of the lifting shaft. The first drive mechanism is connected to the moving member by a transmission device. The first drive mechanism is configured to cause the moving member to move in a reciprocating motion.

In some examples, the cleaning assembly further includes a lifting member that is configured to couple the first end of the lifting shaft and the moving member. The lifting member is configured to cause the lifting shaft to slide along the axial direction of the lifting shaft in response to the motion of the moving member.

In some instances, the cleaning assembly further includes an elastic member that includes a first end and a second end. The first end of the elastic member is connected to the lifting member and the second end of the elastic member is connected to the fixing mechanism. The elastic member is configured to cause the lifting member to abut against the moving member.

In some variations, the elastic member is coaxially sleeved outside the lifting shaft, and a sliding direction of the lifting shaft is along an expansion direction of the elastic member.

In some examples, the moving member includes an inclined surface. The moving member is configured to move along the inclined surface in response to the motion of the moving member.

In some instances, the moving member further includes a first abutment plane and a second abutment plane. The first abutment plane is adjacent to one end of the inclined surface and the second abutment plane is adjacent to the other end of the inclined surface. The lifting member is configured to move along the first abutment plane, the inclined surface, and the second abutment plane in response to the motion of the moving member.

In some variations, the lifting member includes a cylindrical convex portion that abuts against the moving member. The cylindrical convex portion moves along the moving member in response to the motion of the moving member.

In some examples, the first drive mechanism includes a drive motor, an output shaft coupled to the drive motor, and a gear coupled to the output shaft. The moving member includes a rack engaged with the gear of the first drive mechanism. The drive motor is configured to cause the motion of the moving member through the output shaft, the gear of the first drive mechanism, and the rack of the moving member.

In some instances, the cleaning assembly further includes at least another lifting shaft that is parallel to the lifting shaft. The another lifting shaft is connected to another cleaning module.

In some variations, the cleaning assembly further includes a shaft sleeve and a second drive mechanism. The shaft sleeve is coupled to the lifting shaft. The shaft sleeve is configured to cause the lifting shaft to rotate. The second drive mechanism is connected to the shaft sleeve. The second drive mechanism is configured to cause the shaft sleeve to rotate.

In some examples, the lifting shaft is in a splined connection or a keyed connection with the shaft sleeve.

In some instances, the second drive mechanism and the first drive mechanism are arranged on different sides of the lifting shaft.

Further, a cleaning apparatus is provided, which includes a main body and aforesaid cleaning assembly. The main body is connected to the fixing mechanism and the first drive mechanism included in the aforesaid cleaning assembly.

In comparison with the prior art, the first drive mechanism causes the moving member to reciprocate, which causes the lifting shaft to reciprocate along the axial direction thereof, thereby lifting and/or lowering the cleaning module. Consequently, the cleaning module can be lowered during cleaning or lifted when the cleaning module needs to be lifted, which solves the technical problem that the cleaning module cannot be lifted.

BRIEF DESCRIPTION OF THE DRAWINGS

In order to illustrate technical solutions in embodiments of the present disclosure more clearly, the following briefly introduces the accompanying drawings.

DETAILED DESCRIPTION

Figure 1:
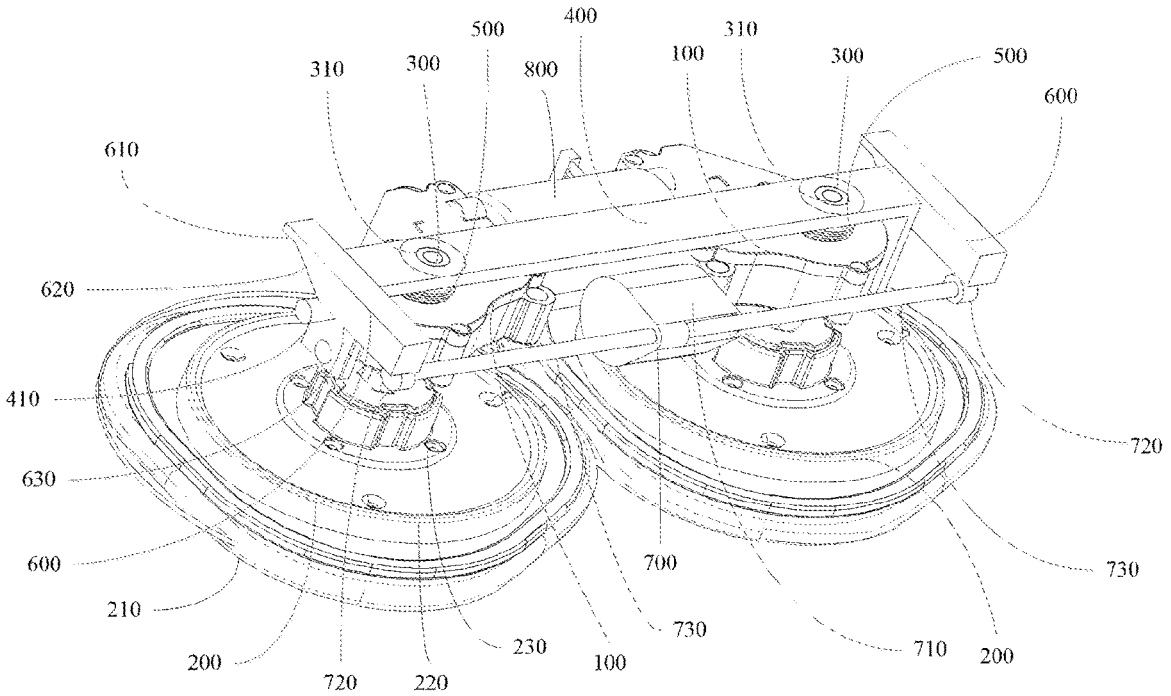
FIG. 1 is a perspective view of a cleaning assembly in accordance with one or more embodiments of the present disclosure.

Exemplary embodiments according to the present disclosure will be described clearly and completely in accordance with the drawings. Nevertheless, it will be understood that the described embodiments are a part of the embodiments of the present disclosure, but not all of them. Based on the embodiments in the present disclosure, all other embodiments obtained by those skilled in the art without creative work shall fall in the protection scope of the present disclosure.

Note that all orientation words such as "forward, backward, up, down, left, right", etc. are only used to explain the relative position relationships and movement of different components under a specific state (as shown in the drawings). When the specific state is changed, the orientation words are also changed accordingly.

Furthermore, in the present disclosure, unless otherwise indicated, the terms "fixed", "connected" and the like should be understood broadly, and maybe, for example, fixed connections, detachable connections, or integral connections; may also be mechanical or electrical connections; may also be direct connections or indirect connections via intervening structures; may also be inner communications or interaction relationships of two elements, which can be understood by those skilled in the art according to specific situations.

In addition, it should be understood that terms such as "first" and "second" are used herein for purposes of description and are not intended to indicate or imply relative importance or significance or to imply the number of indicated technical features. Thus, the feature defined with "first" and "second" may indicate or imply to include one or more technical features. In addition, the words "and/or" means three parallel technical solutions, taking "A and/or B" as an example, including a technical solution A, a technical solution B, and a technical solution that meets both A and B. In addition, various technical solutions of different embodiments can be combined, based on knowledge of one having ordinary skill in the art. When there is conflict after combination of the technical solutions or the combination cannot be achieved, it can be understood that the combination of technical solutions does not exist, and it shall not fall within the scope of the present disclosure.

A cleaning assembly is provided in the present disclosure, where a cleaning module 200 can be lifted.

Figure 2:
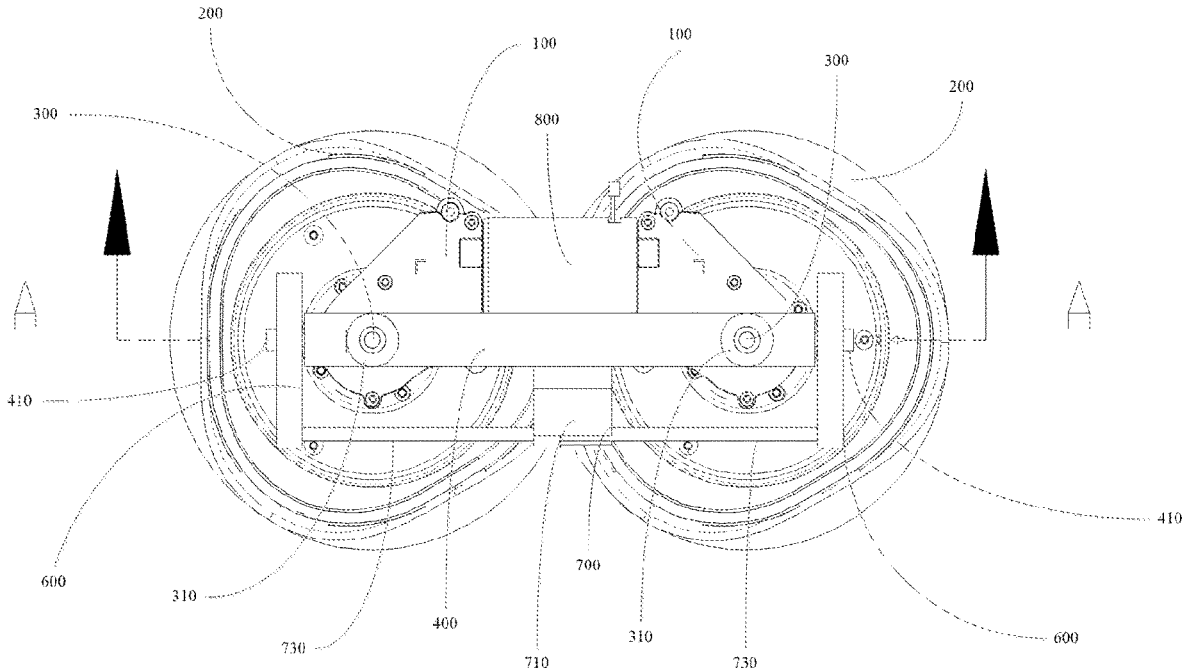
FIG. 2 is a top perspective view of the cleaning assembly shown in FIG. 1.
Figure 3:
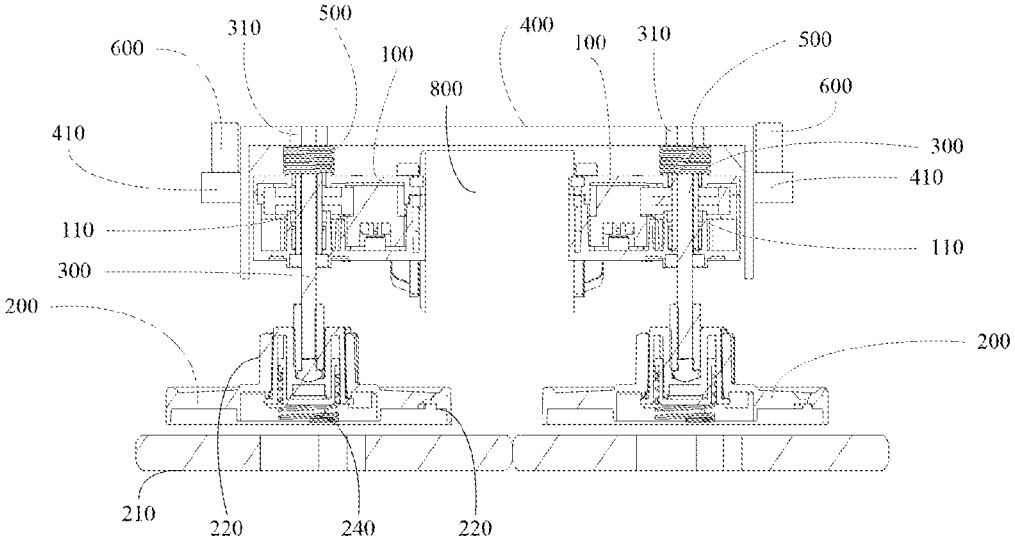
FIG. 3 is a cross-sectional view taken along line A-A in FIG. 2.

As shown in FIGS. 1-3, in one or more embodiments of the present disclosure, the cleaning assembly includes a fixing mechanism 100, a lifting shaft 300, a lifting member 400, an elastic member 500, a moving member 600, a first drive mechanism 700 and a cleaning module 200.

The fixing mechanism 100 is fixedly connected to the main body (not shown).

Moreover, the lifting shaft 300 vertically penetrates through the fixing mechanism 100 and is configured to slide along an axial direction of the lifting shaft 300 relative to the fixing mechanism 100. One end of the lifting shaft 300 is connected to the cleaning module 200, and the other end is connected to the moving member 600.

Furthermore, the elastic member 500 is disposed between the lifting member 400 and the fixing mechanism 100. One end of the elastic member 500 is connected to the lifting member 400, and the other end of the elastic member 500 is connected to the fixing mechanism 100 or the main body. The elastic member 500 exerts a force away from the fixing mechanism 100 on the lifting member 400. The lifting shaft 300 is connected to the moving member 600 by the lifting member 400.

In some instances, the moving member 600 includes an inclined surface 620 that is inclined with respect to a plane perpendicular to the lifting shaft 300. The inclined surface 620 is configured to abut against the lifting member 400 and exerts a force on the lifting member 400 toward the fixing mechanism 100, thereby urging the lifting member 400 to move close to or away from the fixing mechanism 100.

Furthermore, the first drive mechanism 700 is fixedly connected to the main body and connected to the moving member 600 by a transmission device. The first drive mechanism 700 is arranged to drive the moving member 600 to reciprocate, such that the position of the lifting member 400 on the inclined surface 620, where the lifting member abuts against, changes, thereby changing a distance between the lifting member 400 and the fixing mechanism 100 and driving the lifting shaft 300 to slide along the axial direction of the lifting shaft 300.

The main body may include a shell of a cleaning apparatus, such as the shell of a cleaning robot, according to a further embodiment.

In the foregoing embodiment, it is understandable that under the action of the elastic member 500, the lifting member 400 has a tendency to move upward so as to abut against the moving member 600. When the first drive mechanism 700 drives the moving member 600 to reciprocate, the lifting member 400 abuts against different heights of the moving member 600, thereby adjusting the distance between the lifting member 400 and the fixing mechanism 100. And meanwhile, the lifting shaft 300 is driven to reciprocate along the axial direction thereof, thereby lifting or lowering the cleaning module 200. Consequently, the cleaning module 200 can be lowered during cleaning or lifted when the cleaning module 200 needs to be lifted. Thus, a vertical movement is driven by a horizontal movement by implementing the foregoing structure, which is stable and easy to control. Moreover, the space occupation in a vertical direction is reduced.

In some exemplary embodiments, a cylindrical convex portion 410 is disposed on one side of the lifting member 400 towards the moving member 600. The lifting member 400 abuts against the inclined surface 620 through the cylindrical convex portion 410. The cylindrical convex portion 410 moves along the inclined surface 620 of the moving member 600. Due to the shape of the cylindrical convex portion 410, the abutment surface is small, thus facilitating the movement of the moving member 600 and taking into account the stability of the structure.

In some instances, the first drive mechanism 700 includes a drive motor 710 and a gear 720. An output shaft 730 is coupled to the drive motor 710. The gear 720 is coupled to the output shaft 730 of the drive motor 710. Furthermore, the moving member 600 includes a rack (not shown) engaged with the gear 720. The drive motor 710 drives the moving member 600 to reciprocate through the gear 720 and the rack. In some variations, in order to facilitate the moving member 600 to operate with the gear 720 and the convex portion 410, the rack and the inclined surface 620 are arranged at different sides of the moving member 600 respectively.

In some examples, the transmission device configured to drive the moving member 600 may include the rack and the gear 720. The transmission device may provide accurate control on the movement of the moving member 600, so as to cause the movement of the lifting shaft 300 and the cleaning module 200 connected thereto.

In some instances, the cleaning assembly includes a shaft sleeve 110 and a second drive mechanism 800. The shaft sleeve 110 is disposed in the fixing mechanism 100, and penetrated by the lifting shaft 300. The shaft sleeve 110 is coupled to the lifting shaft 300 and is configured to cause the lifting shaft 300 to rotate. Meanwhile, the lifting shaft 300 is movable relative to the shaft sleeve 110. Furthermore, the shaft sleeve 110 is in a transmission connection with the second drive mechanism 800 and driven by the second drive mechanism 800 to rotate so as to drive the lifting shaft 300 to rotate.

In some variations, one end of the lifting shaft 300 is connected with the cleaning module 200, and the other end is rotatably connected with the lifting member 400. The shaft sleeve 110 is arranged inside the fixing mechanism 100, and the lifting shaft 300 penetrates through the shaft sleeve 110. In some examples, the shaft sleeve 110 is coupled to the lifting shaft 300 through a splined connection or a keyed connection. The shaft sleeve 110 is configured to cause the lifting shaft 300 to rotate. In some instances, the second drive mechanism 800 includes a motor and a gear transmission mechanism. The gear transmission mechanism is connected to the motor and driven by the motor for transmission. Furthermore, the gear transmission mechanism is connected to the rotation shaft sleeve 110 and drives the shaft sleeve 110 to rotate, thereby realizing that the shaft sleeve 110 is driven by the second drive mechanism 800 to rotate.

Additionally and/or alternatively, based on the splined connection or keyed connection between the lifting shaft 300 and the shaft sleeve 110, the lifting shaft 300 can slide relative to the shaft sleeve 110, and the shaft sleeve 110 can also drive the lifting shaft 300 to rotate, so as to drive the cleaning module 200 to rotate, thereby cleaning the ground.

In some variations, the second drive mechanism 800 and the first drive mechanism 700 are arranged on both sides of the lifting shaft 300, which is convenient for arrangement and can make full use of the space on both sides of the lifting shaft 300 to reduce the space occupied by the cleaning assembly.

In some examples, the lifting shaft 300 is rotatably connected with the lifting member 400 by a bearing 310, which reduces friction when the lifting shaft 300 rotates and facilitates the lifting member 400 to lift the lifting shaft 300.

In some instances, the elastic member 500 is coaxially disposed outside the lifting shaft 300. In some variations, a sliding direction of the lifting shaft 300 is along an expansion direction of the elastic member 500, so as to make the lifting shaft 300 slide smoothly.

In some examples, the elastic member 500 is stably fixed to reduce its radial deformation, so as to reduce a loss of elasticity and ensure that the elastic member 500 exerts sufficient force on the lifting member 400 along the axial direction of the lifting shaft 300. The elastic member 500 may be a spring, a torsion spring, or other elastic members.

In some instances, the elastic member 500 can also be disposed in other positions between the lifting member 400 and the fixing mechanism 100.

In some variations, the moving member 600 further includes a first abutment plane 610 and a second abutment plane 630, which are both perpendicular to the lifting shaft 300. In some examples, a distance between the first abutment plane 610 and the fixing mechanism 100 is different from that between the second abutment plane 630 and the fixing mechanism 100. Further, the first abutment plane 610 and the second abutment plane 630 are connected by the inclined surface 620. The lifting member 400 is configured to move along the first abutment plane 610, the inclined surface 620 and the second abutment plane 630, which exert a force on the lifting member 400 toward the fixing mechanism 100. The first drive mechanism 700 drives the moving member 600 to reciprocate so that the lifting member 400 abuts against the first abutment plane 610, the inclined surface 620 or the second abutment plane 630.

In some instances, after the cleaning module 200 is lifted or lowered, the lifting member 400 abuts against the first abutment plane 610 or the second abutment plane 630 respectively, so that the lifting member 400 more stably abuts against the moving member 600. The inclined surface 620 ensures a smooth transition during lifting/lowering the cleaning module 200. In some variations, more than two abutment planes may be utilized such that the cleaning module 200 may be stably and flexibly placed at different heights in various situations. As such, more than one inclined surfaces may be implemented between the abutment planes to ensure smooth transitions during the lifting and/or lowering processes.

In some examples, the lifting shaft 300 is detachably connected to the cleaning module 200, which facilitates cleaning, maintenance and replacement of the cleaning module 200.

In some instances, one end of the elastic member 500 abuts against the lifting member 400 and the other end of the elastic member 500 abuts against the fixing mechanism 100. Thus, the elastic member 500 is easy to install or replace after its elasticity is reduced.

In some variations, the cleaning assembly includes two or more lifting shafts 300. All the lifting shafts 300 vertically penetrate through the fixing mechanism 100. One end of each lifting shaft 300 is correspondingly connected with one cleaning module 200, and the other end of each lifting shaft 300 is connected with a lifting member 400. Therefore, all the cleaning modules 200 can be lifted simultaneously, which is convenient for controlling all the cleaning modules 200 simultaneously. Furthermore, multiple cleaning modules 200 can increase the cleaning area. Of course, only one set of lifting shaft 300 and cleaning module 200 is also possible.

In some examples, the cleaning module 200 includes a cleaning turntable 220 with a mop, a brush and/or a dust suction joint.

In some instances, the cleaning module 200 further includes a built-in pressure unit 240, which can realize floating. For instance, the cleaning module 200 includes a cleaning turntable 220, a cleaning member 210, an adjustment assembly 230, and the pressure unit 240. One side of the cleaning turntable 220 is connected with a cleaning member 210 for cleaning the ground. Furthermore, the adjustment assembly 230 is disposed on one side of cleaning turntable 220 that is away from the cleaning member 210. The adjustment assembly 230 is connected to the cleaning turntable 220 and may slide along the axial direction of the lifting shaft 300. For example, the adjustment assembly 230 is in a keyed connection with the cleaning turntable 220, and the adjustment assembly 230 is fixedly connected with a lower end of the lifting shaft 300. Therefore, the lifting shaft 300 rotates to drive the adjustment assembly 230 and the cleaning turntable 220 to rotate. In some variations, the pressure unit 240 is disposed between the adjustment assembly 230 and the cleaning turntable 220, and used to apply a force on the cleaning turntable 220 toward the ground. In some examples the pressure unit 240 may be a spring or the like.

Thus, during cleaning of the ground by the cleaning module 200, when the ground is relatively flat, the cleaning member 210 fits the ground better, and the cleaning effect is good. When the ground is uneven, the pressure unit 240 presses down the cleaning turntable 220 and the cleaning member 210, thus improving fitting between the cleaning member 210 and the ground and ensuring a good cleaning effect. The cleaning member 210 can be a mop, a brush, a dust suction joint, and the like.

In some instances, the cleaning module 200, the fixing mechanism 100, the lifting member 400, the moving member 600 and the rack are all set parallel to the ground. Moreover, the lifting shaft 300, the shaft sleeve 110 and the elastic member 500 are arranged perpendicular to the ground, and the lifting shaft 300 vertically penetrates through the fixing mechanism 100. Furthermore, the lower end of the lifting shaft 300 is connected to the cleaning module 200 by a detachable structure, such as a buckle or a bolt, and the upper end of the lifting shaft 300 is connected with the lifting member 400 by a rotatable structure, such as a bearing 310.

In some variations, the elastic member 500 is coaxially disposed outside the lifting shaft 300 and sandwiched between the fixing mechanism 100 and the lifting member 400, and a first end and a second end of the elastic member 500 abut against an upper surface of the fixing mechanism 100 and a lower surface of the lifting member 400, respectively. Furthermore, the second drive mechanism 800 and the shaft sleeve 110 are arranged inside the fixing mechanism 100, and the second drive mechanism 800 is connected to the shaft sleeve 110 in a transmission connection and drives the shaft sleeve 110 to rotate. In some examples, the lifting shaft 300 is coupled to the shaft sleeve 110 in a splined connection or a keyed connection. For instance, the connection between the lifting shaft 300 and the shaft sleeve 110 may allow the lifting shaft 300 to slide up and down relative to the rotation shaft sleeve 110 and drives the lifting shaft 300 to rotate.

In some instances, the first abutment plane 610, the inclined surface 620 and the second abutment plane 630 on the moving member 600 all face downward. In some variations, the lifting member 400 is perpendicular to the moving member 600. Both ends of the lifting member 400 are connected to one moving member 600 and abut against the lower surface of the corresponding moving member 600. In some instances, the output shaft 730 of the drive motor 710 is parallel to the lifting member 400, and the rack is perpendicular to the lifting member 400 and fixed on the moving member 600. In some variations, the rack is a straight rack extended along an extending direction of the moving member 600, and the gear 720 is engaged with the rack on the moving member 600. In some examples, the moving member 600 includes two racks, which are located at both ends of the lifting member 400. The moving member 600 including the two racks are in a transmission connection with the output shaft 730 of the drive motor 710.

In some instances, the drive motor 710 are coupled to two output shafts 730 that extend in different directions, and each output shaft 730 is coupled to one gear 720. The gear 720 rotates and causes the rack to drive the moving member 600 to reciprocate linearly in a direction perpendicular to the lifting shaft 300, thereby urging an end of the lifting member 400 to move along the first abutment plane 610, the inclined surface 620, and the second abutment plane 630 of the moving member 600. Thus, the vertical position of the lifting member 400 is controlled by the varying height of the first abutment plane 610, the inclined surface 620 and the second abutment plane 630 of the moving member 600, which forces the lifting member 400 down. As such, the cleaning assembly adjusts the distance between the lifting member 400 and the fixing mechanism 100 so as to lift the lifting shaft 300 and the cleaning module 200.

The cleaning assembly may include multiple cleaning modules 200. In some variations, the multiple cleaning modules 200 are connected to multiple lifting shafts 300 and shaft sleeves 110. For instance, each cleaning module 200 may be connected to a separate set of a lifting shaft 300 and a shaft sleeve 110. Furthermore, the upper ends of all the lifting shafts 300 pass through the fixing mechanism 100 and are rotatably connected with the lifting member 400. Each of the lifting shafts 300 is connected to the lifting member 400 by a corresponding bearing 310, and is sleeved by a separate elastic member 500 to ensure the elasticity of the lifting member 400.

According to a further embodiment, a Cartesian coordinate system for a three-dimensional space may be established, in which an X axis is arranged along an extension direction of the moving member 600, a Y axis is arranged along an extension direction of the lifting member 400, and a Z axis is arranged along the axial direction of the lifting shaft 300. In some examples, the moving member 600 and the inclined surface 620 thereof move linearly back and forth along the X axis, so that the lifting member 400 abuts against the moving member 600 at different positions that corresponds to different heights, so as to lift the lifting shaft 300 and the cleaning module 200 connected thereto.

The cleaning apparatus provided by the present disclosure includes a main body (not shown) and the foregoing cleaning assembly in accordance with one or more embodiments.

It is understood that the cleaning apparatus includes all the technical features of the foregoing cleaning assembly, so at least all the beneficial effects brought by the technical solutions of the foregoing cleaning assembly will be obtained, which will not be described here.

In some examples, the cleaning apparatus can be a floor cleaning device such as a cleaning robot or a vacuum cleaner, and can also be a cleaning equipment used to clean walls, glass, ceilings, etc.

The foregoing descriptions are merely exemplary embodiments of the present disclosure and are not intended to limit the patent scope of the present disclosure. Any equivalent structures made according to the description and the accompanying drawings of the present disclosure without departing from the idea of the present disclosure, or any equivalent structures applied in other relevant technical fields directly or indirectly are intended to be included in the patent protection scope of the present disclosure.

What is claimed is:

1. A cleaning assembly, comprising:

a fixing mechanism;

a lifting shaft penetrating through the fixing mechanism and configured to slide along an axial direction of the lifting shaft relative to the fixing mechanism, and the lifting shaft comprising a first end and a second end;

a moving member connected to the first end of the lifting shaft and configured to cause the lifting shaft to slide along the axial direction of the lifting shaft;

a cleaning module connected to the second end of the lifting shaft;

a first drive mechanism connected to the moving member through a transmission device and configured to cause the moving member to move in a reciprocating motion;

a lifting member configured to:

couple the first end of the lifting shaft and the moving member, and cause the lifting shaft to slide along the axial direction of the lifting shaft in response to the motion of the moving member; and an elastic member comprising a first end connected to the lifting member and a second end connected to the fixing mechanism, the elastic member being configured to cause the lifting member to abut against the moving member.

2. The cleaning assembly of claim 1, wherein the elastic member is coaxially sleeved outside the lifting shaft, and a sliding direction of the lifting shaft is along an expansion direction of the elastic member.

3. The cleaning assembly of claim 1, wherein the moving member comprises an inclined surface, and the lifting member is configured to move along the inclined surface in response to the motion of the moving member.

4. The cleaning assembly of claim 3, wherein the moving member further comprises a first abutment plane and a second abut plane, wherein the first abutment plane is adjacent to one end of the inclined surface, and the second abutment plane is adjacent to the other end of the inclined surface, and wherein the lifting member is configured to move along the first abutment plane, the inclined surface, and the second abutment plane in response to the motion of the moving member.

5. The cleaning assembly of claim 1, wherein the lifting member comprises a cylindrical convex portion that abuts against the moving member, and the cylindrical convex portion moves along the moving member in response to the motion of the moving member.

6. The cleaning assembly of claim 1, wherein the first drive mechanism comprises a drive motor, an output shaft coupled to the drive motor, and a gear coupled to the output shaft, wherein the moving member comprises a rack engaged with the gear of the first drive mechanism, and wherein the drive motor is configured to cause the motion of the moving member through the output shaft, the gear of the first driving mechanism, and the rack of the moving member.

7. The cleaning assembly of claim 1, further comprising at least another lifting shaft parallel to the lifting shaft and connected to another cleaning module.

8. The cleaning assembly of claim 1, further comprising:

a shaft sleeve coupled to the lifting shaft through a splined connection or a keyed connection and configured to cause the lifting shaft to rotate; and a second drive mechanism connected to the shaft sleeve and configured to cause the shaft sleeve to rotate.

9. A cleaning apparatus, comprising:

a main body;

a fixing mechanism connected to the main body;

a lifting shaft penetrating through the fixing mechanism and configured to slide along an axial direction of the lifting shaft relative to the fixing mechanism, and the lifting shaft comprising a first end and a second end;

a moving member connected to the first end of the lifting shaft and configured to cause the lifting shaft to slide along the axial direction of the lifting shaft;

a cleaning module connected to the second end of the lifting shaft;

a first drive mechanism connected to the main body, connected to the moving member through a transmission device, and configured to cause the moving member to move in a reciprocating motion;

a lifting member configured to:

couple the first end of the lifting shaft and the moving member, and cause the lifting shaft to slide along the axial direction of the lifting shaft in response to the motion of the moving member; and an elastic member comprising a first end connected to the lifting member and a second end connected to the fixing mechanism, the elastic member being configured to cause the lifting member to abut against the moving member.

10. The cleaning assembly of claim 9, wherein the elastic member is coaxially sleeved outside the lifting shaft, and a sliding direction of the lifting shaft is along an expansion direction of the elastic member.

11. The cleaning apparatus of claim 9, wherein the moving member comprises an inclined surface, and the lifting member is configured to move along the inclined surface in response to the motion of the moving member.

12. The cleaning apparatus of claim 10, wherein the moving member further comprises a first abutment plane and a second abutment plane, wherein the first abutment plane is adjacent to one end of the inclined surface, and the second abutment plane is adjacent to the other end of the inclined surface, and wherein the lifting member is configured to move along the first abutment plane, the inclined surface, and the second abutment plane in response to the motion of the moving member.

13. The cleaning assembly of claim 9, wherein the lifting member comprises a cylindrical convex portion that abuts against the moving member, and the cylindrical convex portion moves along the moving member in response to the motion of the moving member.

14. The cleaning apparatus of claim 9, wherein the first drive mechanism comprises a drive motor, an output shaft coupled to the drive motor, and a gear coupled to the output shaft, wherein the moving member comprises a rack engaged with the gear of the first drive mechanism, and wherein the drive motor is configured to cause the motion of the moving member through the output shaft, the gear of the first driving mechanism, and the rack of the moving member.

15. The cleaning apparatus of claim 9, further comprising at least another lifting shaft parallel to the lifting shaft and connected to another cleaning module.

16. The cleaning apparatus of claim 9, further comprising:

a shaft sleeve coupled to the lifting shaft through a splined connection or a keyed connection and configured to cause the lifting shaft to rotate; and a second drive mechanism connected to the shaft sleeve and configured to cause the shaft sleeve to rotate.

* * * * *